United States Patent [19]

Beisel

[11] 4,337,699

[45] Jul. 6, 1982

[54] DEVICE FOR AXIALLY RECIPROCATING AN INKING-UNIT ROLLER

[75] Inventor: Hermann Beisel, Walldorf, Fed. Rep. of Germany

[73] Assignee: Heidelberger Druckmaschinen Aktiengesellschaft, Heidelberg, Fed. Rep. of Germany

[21] Appl. No.: 173,763

[22] Filed: Jul. 30, 1980

[30] Foreign Application Priority Data

Aug. 1, 1979 [DE] Fed. Rep. of Germany ..... 2931141

[51] Int. Cl.[3] ..... B41F 1/46

[52] U.S. Cl. ..... 101/348; 101/DIG. 14; 74/57

[58] Field of Search ..... 101/DIG. 14, 348, 349, 101/350, 205, 206; 74/388, 57

[56] References Cited

U.S. PATENT DOCUMENTS

| | | | |
|---|---|---|---|
| 3,110,253 | 11/1963 | Du Bois | 101/348 |
| 3,590,644 | 7/1971 | Kuspert | 74/57 |
| 3,815,498 | 6/1974 | Harrod | 101/DIG. 14 X |
| 4,090,478 | 5/1978 | Trimble et al. | 74/57 |
| 4,170,176 | 10/1979 | Domeniconi | 101/DIG. 14 X |

*Primary Examiner*—Clifford D. Crowder
*Assistant Examiner*—David J. Isabella
*Attorney, Agent, or Firm*—Herbert L. Lerner; Laurence A. Greenberg

[57] ABSTRACT

Device for axially reciprocating a printing-unit roller having a stationary shaft and a roller jacket rotatably driven by friction drive, the device being disposed within the printing-unit roller and being driven by rotational movement of the printing-unit roller, including drive means for effecting axial reciprocation of the printing-unit roller at a speed reduced with respect to the rotational speed of the printing-unit roller including two roller bearings disposed within the printing-unit roller between the roller jacket and the shaft, a first bushing revolving as a cage associated with the roller bearings and being formed with a first groove, a second bushing fixed in the roller jacket and formed with a second groove, one of the grooves being of elliptic form, and a ball being received simultaneously in both of the grooves and being rollable therein.

4 Claims, 2 Drawing Figures

DEVICE FOR AXIALLY RECIPROCATING AN INKING-UNIT ROLLER

Figure 1:
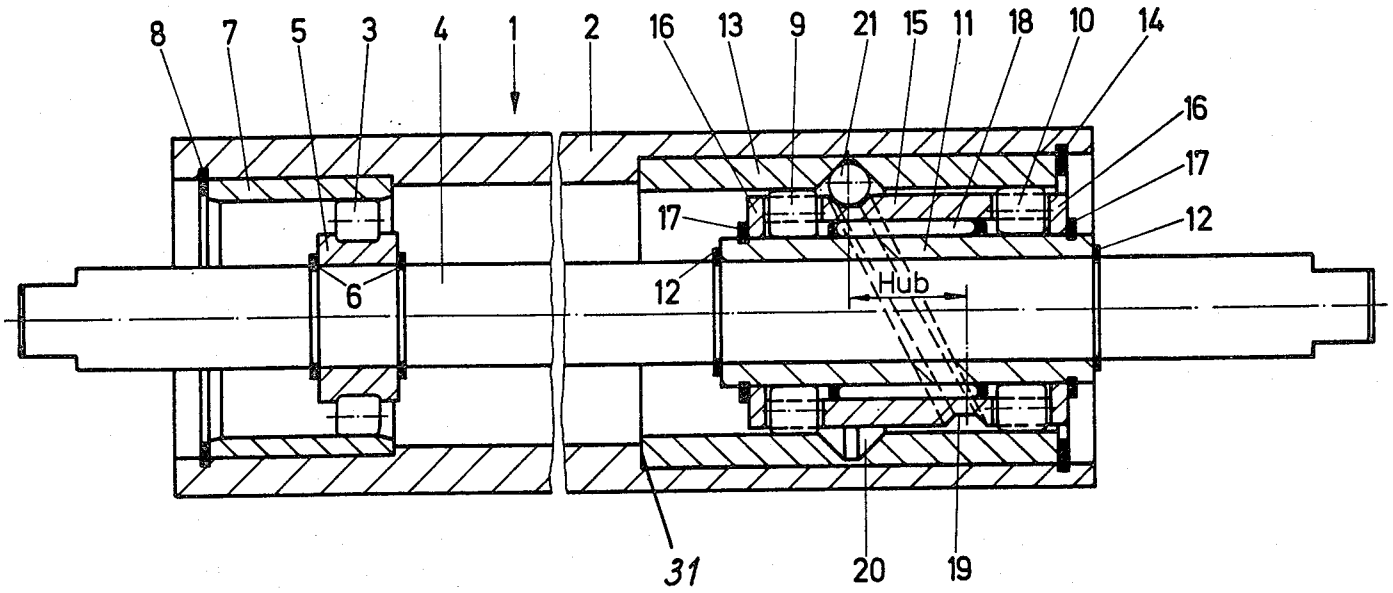

The invention relates to a device for axially reciprocating an inking-unit roller of a printing machine and, more particularly, to such a roller having a stationary shaft and a roller jacket rotatably driven by friction drive.

A heretofore known device of this general type (U.S. Pat. No. 3,110,253) employs, for the purpose of reciprocating inking-unit rollers, a groove pair provided within the respective roller, one of the grooves having an elliptic form. A ball rides or rolls between both of the grooves so that a reduction or step-down in the speed of the reciprocatory movement occurs. In this heretofore-known construction, a speed reduction or stepdown ratio of about 1:2 is attained. If a greater or longer stroke of the reciprocatory movement is required, the speed reduction or stepdown ratio is often insufficient for avoiding the occurrence of a shock or jolt when the reciprocating roller reverses its direction, which then becomes noticeable in the ink transfer.

It is accordingly an object of the invention to provide a device of axially reciprocating an inking-unit roller of the foregoing general type wherein, with relatively simple means, a greater speed reduction or step-down ratio is attained, in order to achieve a smooth and jolt-free reversing movement of the roller even for a considerably lengthened reciprocation stroke. With the foregoing and other objects in view there is provided, in accordance with the invention, a device for axially reciprocating a printing-unit roller having a stationary shaft and a roller jacket rotatably driven by friction drive, the device being disposed within the printing-unit roller and being driven by rotational movement of the printing-unit roller, comprising drive means for effecting axial reciprocation of the printing-unit roller at a speed reduced with respect to the rotational speed of the printing-unit roller including two roller bearings disposed within the printing-unit roller between the roller jacket and the shaft, a first bushing also disposed within the roller between the roller jacket and the shaft and formed with cutouts through which the roller bearings extend as well as with a first groove, a second bushing fixed in the roller jacket and formed with a second groove, one of the grooves being of elliptical form and a ball disposed between both of the grooves and being received simultaneously in both of the grooves and being rollable therein.

In this manner, the speed reduction or step-down ratio between the reciprocation and the revolving of the printing-unit roller is doubled to about 1:4 without requiring great technical expense. Even if the stroke length is then doubled, no jolt-like reversal movement of the inking-unit roller occurs.

In accordance with a more specific feature of the invention, the elliptically formed groove is the first groove, and the second groove is circular and is disposed opposite the first groove. In accordance with an alternative feature of the invention, the first groove is circular, and the elliptically formed groove is the second groove and is disposed opposite the first groove.

In accordance with a concomitant feature of the invention, the other of the grooves is circular, the elliptically formed and the circular grooves being disposed in respective planes intersecting with one another. Other features which are considered as characteristic for the invention are set forth in the appended claims.

Although the invention is illustrated and described herein as embodied in a device for axially reciprocating an inking-unit roller, it is nevertheless not intended to be limited to the details shown, since various modifications and structural changes may be made therein without departing from the spirit of the invention and within the scope and range of equivalents of the claims.

Figure 2:
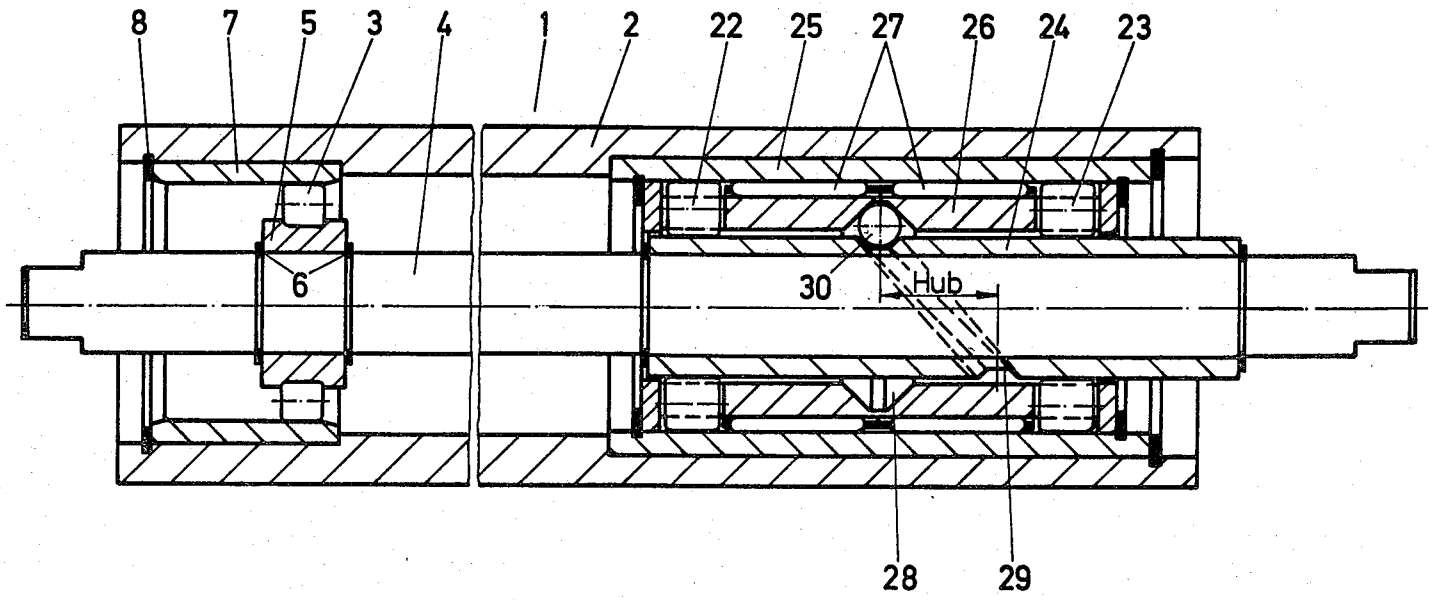

The construction and method of operation of the invention, however, together with additional objects and advantages thereof will be best understood from the following description of specific embodiments when read in connection with the accompanying drawings, in which:

FIG. 1 is a longitudinal sectional view of an embodiment of an inking-unit roller according to the invention provided with a revolving bushing formed with an elliptic groove; and FIG. 2 is a view similar to that of FIG. 1 of another embodiment of the inking-unit roller with a revolving bushing formed with a circular groove.

Referring now to the figures of the drawing, there is shown an inking-unit roller 1 according to the invention disposed in a conventional manner in an inking unit of a gravure of offset printing machine and performing a reciprocating movement so as to effect distribution of an ink film. In the illustrated embodiments of FIGS. 1 and 2, the roller casing or jacket 2 is driven i.e. rotated by frictional engagement with non-illustrated rotating rollers cooperating therewith. The roller casing 2 is supported at one end thereof by a roller bearing 3 on a stationary shaft 4. The roller bearing 3 has an inner race 5 which is fixed on the shaft 4 by spring washers 6. The outer race 7 of the roller bearing 3 is fixed by a spring washer 8 in the roller casing or jacket 2 and is made so wide or broad as to accommodate the maximum stroke of the reciprocating movement of the roller casing or jacket 2.

According to FIG. 1, the other end of the roller casing or jacket 2 is supported by two roller bearings 9 and 10 on the stationary shaft 4, a bushing 11 being provided as inner race for both roller bearings 9 and 10 and being fixed by spring washers 12 on the shaft 4. A wider or broader bushing 13 serves as outer race for the roller bearings 9 and 10 and is fixed in the roller casing or jacket 2 by an inner spring washer 14 together with a shoulder 31 formed in the roller casing or jacket 2. A bushing 15 revolving as a cage on needle bearings 18 serves as guidance for the two roller bearings 9 and 10. As shown by the broken lines in FIG. 1, suitable cutouts are formed in the bushing 15 through which the roller bearings 9 and 10 extend. The bushing 15 is retained laterally by rings 16 which are, in turn, fixed by spring washers 17 on the inner race bushing 11.

In the illustrated embodiment of FIG. 1, the bushing 15 revolving like a cage is formed with a first groove 19 of elliptical form, and the bushing 13 fastened in the roller casing or jacket 2 is formed with an opposing second groove 20 having a circular form. For special cases, the second groove 20 could also have a slightly elliptical form. A ball 21 rides or rolls in both grooves 19 and 20, effecting thereby a sinusoidal reciprocation of the roller casing or jacket 2. By the mere fact of the riding or roller of the ball 21, a speed reduction or step-down occurs between the bushings 13 and 15. After the bushing 15 revolves in the same rotary direction as that of the roller casing or jacket 2, a further step-down or speed reduction occurs again for the latter due to the rolling of the roller bearing 9, 10 so that the total speed reduction or step-down for the reciprocating movement of the roller casing or jacket 2 is about 1:4. The stroke Hub for the reciprocating movement indicated in FIG. 1, which is produced by the elliptically formed groove 19, can be roughly doubled without adversely affecting the reciprocating movement.

The embodiment of the inking-unit roller according to the invention shown in FIG. 2 differs from that of FIG. 1 in that it has a construction deviating somewhat therefrom. In FIG. 2, as well, the roller casing or jacket 2 is supported by two roller bearings 22 and 23 having an inner race formed, in common, of a bushing 24 fixed to the stationary shaft 4 and an outer race formed, in common, of a bushing 25 fastened in the roller casing or jacket 2. In this case, also, a revolving bushing 26 is used as a cage for both roller bearings 22 and 23, the revolving bushing 26 being supported by two needle bearings 27 in the bushing 25. The fixing of the individual bushings 24, 25 and 26 is effected generally in the same manner as for the corresponding bushings of FIG. 1 with the use of suitable spring washers, as indicated diagrammatically.

In contrast to the embodiment illustrated in FIG. 1, for the purpose of effecting lateral reciprocatory movement of the roller casing or jacket 2, in the embodiment shown in FIG. 2, the bushing 26 revolving as a cage is provided with a circular first groove 28 and the bushing 24 fastened to the shaft 4 is provided with an ellipsoidal second groove 29, a ball 30 riding or rolling in both of the grooves 28 and 29. With this embodiment, as well, a total speed reduction or step-down ratio of about 1:4 may be achieved so that the stroke Hub indicated in FIG. 2 produces the equivalent travel distance for the roller casing or jacket 2.

The device according to the invention illustrated in the figures, which axially reciprocates an inking-unit roller is constructed so as to find application or use for various roller diameters, and so that the stationary shafts of the inking-unit rollers can be supported at any desired or required locations in the lateral frames of the printing machine.

There are claimed:

1. Device for axially reciprocating a printing-unit roller having a stationary shaft and a roller jacket rotatably driven by friction drive, the device being disposed within the printing-unit roller and being driven by rotational movement of the printing-unit roller, comprising drive means for effecting axial reciprocation of the printing-unit roller at a speed reduced with respect to the rotational speed of the printing-unit roller including two roller bearings disposed within the printing-unit roller between the roller jacket and the shaft, a first bushing also disposed within the roller between the roller jacket and the shaft and formed with cutouts through which said roller bearings extend, as well as with a first groove, a second bushing fixed in the roller jacket and formed with a second groove, one of said grooves being of elliptic form, said first bushing being revolvable as a cage and a ball being received simultaneously in both of said grooves and being rollable therein.

2. Device according to claim 1 wherein the elliptically formed groove is said first groove and said second groove is circular and is disposed opposite said first groove.

3. Device according to claim 1 wherein said first groove is circular, and the elliptically formed groove is said second groove and is disposed opposite said first groove.

4. Device according to claim 1 wherein the other of said grooves is circular, said elliptically formed and said circular grooves being disposed in respective planes intersecting with one another.

* * * * *